US010041705B2

(12) United States Patent
Jeung et al.

(10) Patent No.: US 10,041,705 B2
(45) Date of Patent: Aug. 7, 2018

(54) OUTDOOR DEVICE FOR AN AIR CONDITIONER

(71) Applicant: LG ELECTRONICS INC., Seoul (KR)

(72) Inventors: Jonghwan Jeung, Seoul (KR); Hoki Lee, Seoul (KR); Sangyoung Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 280 days.

(21) Appl. No.: 14/935,089

(22) Filed: Nov. 6, 2015

(65) Prior Publication Data

US 2016/0178250 A1 Jun. 23, 2016

(30) Foreign Application Priority Data

Dec. 17, 2014 (KR) ..... 10-2014-0182091
May 7, 2015 (KR) ..... 10-2015-0063718

(51) Int. Cl.
*F25B 13/00* (2006.01)
*F25B 43/00* (2006.01)
(Continued)

(52) U.S. Cl.
CPC ..... *F25B 13/00* (2013.01); *F25B 43/006* (2013.01); *F25B 45/00* (2013.01); *F25B 49/02* (2013.01);
(Continued)

(58) Field of Classification Search
CPC ..... F25B 13/00; F25B 49/02; F25B 45/00; F25B 43/006; F25B 2345/004;
(Continued)

(56) References Cited

U.S. PATENT DOCUMENTS 3,643,465 A * 2/1972 Bottum ..... F17C 13/00 137/592
3,922,875 A * 12/1975 Morris, Jr. ..... F25B 40/00 62/156
(Continued)

FOREIGN PATENT DOCUMENTS

CN 2890771 4/2007
CN 101799224 8/2010
(Continued)

OTHER PUBLICATIONS

Hirata et al., Freezer, Dec. 14, 1992, JPH04359755A, Whole Document.*
(Continued)

*Primary Examiner* — Larry Furdge
(74) *Attorney, Agent, or Firm* — Ked & Associates LLP

(57) ABSTRACT

An outdoor device for an air conditioner is provided that may include a compressor that compresses a refrigerant, a condenser that condenses the refrigerant compressed in the compressor, an expansion device that decompresses the refrigerant condensed in the condenser, an evaporator that evaporates the refrigerant decompressed in the expansion device, and a refrigerant storage that bypasses at least a portion of the refrigerant condensed in the condenser to store the bypassed refrigerant therein. The refrigerant storage may include a first storage that stores the bypassed refrigerant, and a second storage in which the refrigerant passing through the evaporator is introduced. The second storage may discharge a gaseous refrigerant of the introduced refrigerant to the compressor. The first storage may be provided above the second storage to supply the refrigerant stored therein into the second storage.

20 Claims, 5 Drawing Sheets

(51) Int. Cl.
*F25B 45/00* (2006.01)
*F25B 49/02* (2006.01)

(52) U.S. Cl.
CPC ... *F25B 2313/001* (2013.01); *F25B 2313/005* (2013.01); *F25B 2313/0253* (2013.01); *F25B 2313/02742* (2013.01); *F25B 2345/004* (2013.01); *F25B 2400/04* (2013.01); *F25B 2400/13* (2013.01); *F25B 2400/23* (2013.01); *F25B 2400/24* (2013.01)

(58) Field of Classification Search
CPC ..... F25B 2313/02742; F25B 2400/23; F25B 2313/005; F25B 2313/001; F25B 2400/24; F25B 2400/13; F25B 2400/04; F25B 2313/0253
See application file for complete search history.

(56) References Cited

U.S. PATENT DOCUMENTS

| | | | | |
|---|---|---|---|---|
| 5,887,444 | A * | 3/1999 | Toyoshima | F25B 43/006 62/192 |
| 2004/0025526 | A1* | 2/2004 | Aflekt | F24F 3/1405 62/324.1 |
| 2013/0061614 | A1* | 3/2013 | Jeong | F25B 49/02 62/77 |
| 2013/0098072 | A1* | 4/2013 | Choi | F25B 13/00 62/77 |
| 2013/0104594 | A1 | 5/2013 | Lee | |
| 2014/0033741 | A1 | 2/2014 | Song et al. | |

FOREIGN PATENT DOCUMENTS

| | | | |
|---|---|---|---|
| CN | 103090470 | | 5/2013 |
| EP | 2 587 177 | | 5/2013 |
| EP | 2 631 563 | | 8/2013 |
| JP | H04359755 | A * | 12/1992 |
| JP | 2002-295927 | | 10/2002 |
| JP | 2013053757 | A * | 3/2013 |
| KR | 10-2010-0061184 | | 6/2010 |
| KR | 10-2012-0077520 | | 7/2012 |
| KR | 10-2013-0124256 | | 11/2013 |
| KR | 10-2014-0018524 | | 2/2014 |

OTHER PUBLICATIONS

Sato et al., Refrigerant Circuit System, Mar. 21, 2013, JP2013053757A, Whole Document.*
Korean Office Action dated Apr. 14, 2016.
European Search Report dated May 13, 2016.
Chinese Office Action dated Jul. 31, 2017 issued in Application No. 201510514654.0 (with English translation).

* cited by examiner

OUTDOOR DEVICE FOR AN AIR CONDITIONER

CROSS-REFERENCE TO RELATED APPLICATION(S)

The present application claims priority under 35 U.S.C. 119 and 35 U.S.C. 365 to Korean Patent Application Nos. 10-2014-0182091, filed in Korea on Dec. 17, 2014 and 10-2015-0063718, filed in Korea on May 7, 2015, which are hereby incorporated by reference in their entirety.

BACKGROUND

1. Field

An outdoor device for an air conditioner is disclosed herein.

2. Background

Air conditioners are apparatuses that maintain air within a predetermined space at a most proper state according to a use and purpose thereof. In general, such an air conditioner may include a compressor, a condenser, an expansion device, and evaporator. Thus, the air conditioner has a refrigerant cycle in which compression, condensation, expansion, and evaporation processes of a refrigerant are performed. Thus, the air conditioner may heat or cool a predetermined space.

The predetermined space may be variously provided according to a place at which the air conditioner is used. For example, when the air conditioner is provided in a home or office, the predetermined space may be an indoor space of a house or building. On the other hand, when the air conditioner is provided in a vehicle, the predetermined space may be a space in which a person rides.

Such an air conditioner may be operated in a cooling mode or a heating mode. When the air conditioner operates in the cooling mode, an outdoor heat exchanger may serve as a condenser, and an indoor heat exchanger may serve as an evaporator. On the other hand, when the air conditioner operates in the heating mode, the outdoor heat exchanger may serve as an evaporator, and the indoor heat exchanger may serve as a condenser. A flow adjustment valve that adjusts a flow direction of the refrigerant may be provided in the air conditioner to convert the operation of the air conditioner into the cooling mode or the heating mode.

The air conditioner may include a gas/liquid separator provided on an inlet-side of the compressor to separate a gaseous refrigerant of the refrigerant passing through the evaporator and introduce the gaseous refrigerant into the compressor. The air conditioner may further include a receiver that stores at least a portion of the condensed refrigerant.

The gas/liquid separator and the receiver may be integrated with each other. The present Applicant filed an application with respect to an integrated structure of a gas/liquid separator and a receiver, Korean Patent Application No. 10-2012-0077520 (hereinafter "related application"), filed on Jul. 17, 2012 and entitled "Air Conditioner", which is hereby incorporated by reference.

According to the related application, the receiver may be provided below the gas/liquid separator, and thus, the refrigerant may not be smoothly supplied from the receiver to the gas/liquid separator. As the refrigerant passing through a supercooling heat exchanger is supplied into a gas/liquid inflow tube having a relatively small volume, noise due to flow of the refrigerant may occur.

BRIEF DESCRIPTION OF THE DRAWINGS

Embodiments will be described in detail with reference to the following drawings in which like reference numerals refer to like elements, and wherein.

DETAILED DESCRIPTION

Figure 1:
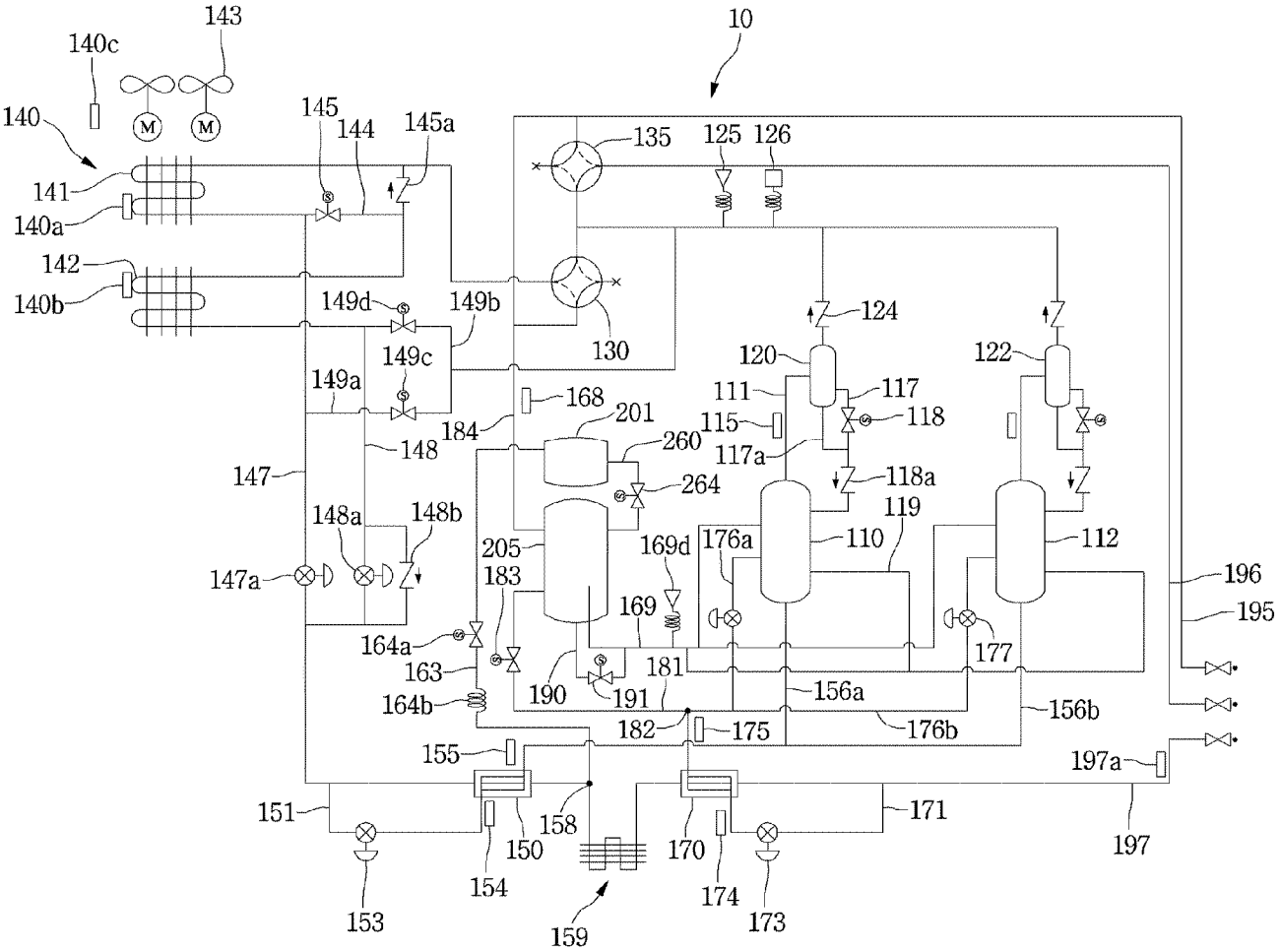
FIG. 1 is a schematic diagram of an outdoor device for an air conditioner according to an embodiment.

Embodiments will be described below in detail with reference to the accompanying drawings. Note that the same or similar components in the drawings are designated by the same reference numerals as far as possible even if they are shown in different drawings. In the following description, a detailed description of known functions and configurations incorporated herein will be omitted to avoid making the subject matter unclear.

In the description of elements, the terms 'first', 'second, A, B, (a)', and '(b)' may be used. However, as the terms are used only to distinguish an element from another, the essence, sequence, and order of the elements are not limited by them. When it is described that an element is "coupled to", "engaged with", or "connected to" another element, it should be understood that the element may be directly coupled or connected to the other element but still another element may be "coupled to", "engaged with", or "connected to" the other element between them.

Figure 2:
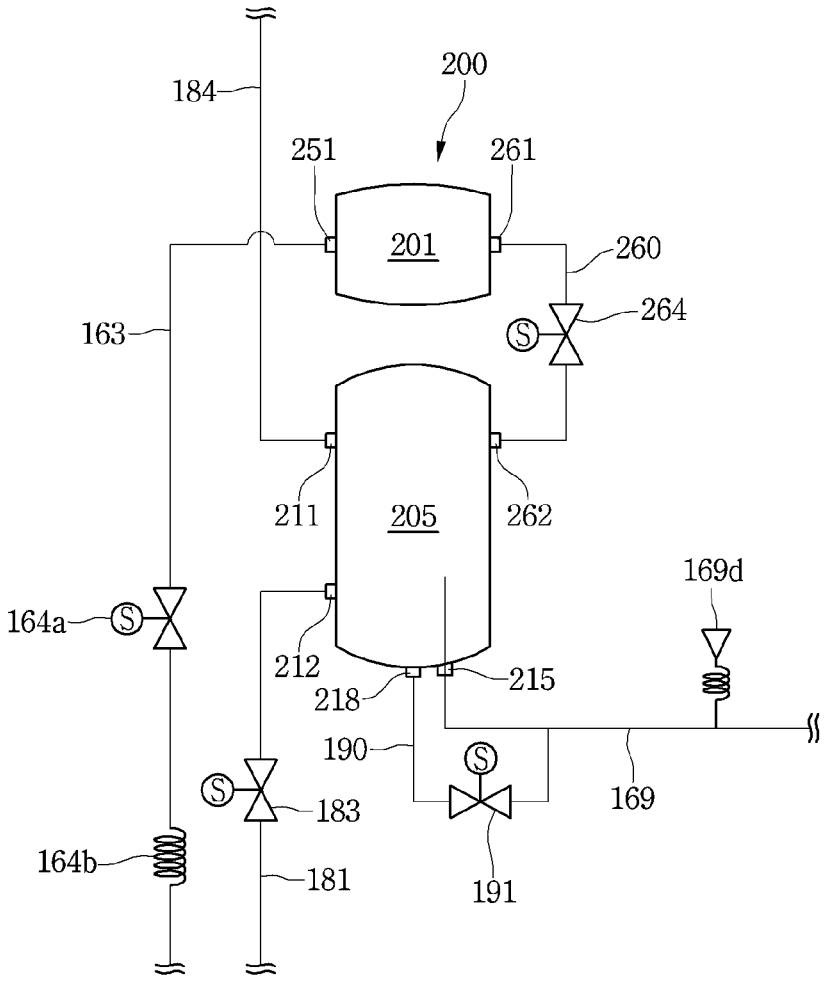
FIG. 2 is an enlarged view illustrating a portion of the outdoor device of FIG. 1.

FIG. 1 is a schematic diagram of an outdoor device for an air conditioner according to an embodiment. FIG. 2 is an enlarged view illustrating a portion of the outdoor device of FIG. 1.

Referring to FIG. 1, an outdoor unit or device for an air conditioner 10 according to an embodiment may be provided in an outdoor space and be in communication with an indoor unit or device in an indoor space. The indoor device may include an indoor heat exchanger heat-exchanged with air of the indoor space.

The outdoor device for an air conditioner 10 may include a plurality of compressors 110 and 112 and a plurality of oil separators 120 and 122, respectively, provided on or at outlet-sides of the plurality of compressors 110 and 112 to separate oil from a refrigerant discharged from the plurality of compressors 110 and 112. The plurality of compressors 110 and 112 may include a first compressor 110 and a second compressor 112, which may be connected in parallel to each other. For example, the first compressor 110 may be a main compressor, and the second compressor 112 may be a sub compressor.

The first compressor 110 may operate first, and then the second compressor 112 may additionally operate if a capacity of the first compressor 110 is insufficient, according to a capacity of a system. For example, each of the first and second compressors 110 and 112 may include an inverter compressor.

A discharge tube 111 may extend from each of the first and second compressors 110 and 112. A discharge temperature sensor 115 that detects a temperature of the refrigerant compressed in each of the first and second compressors 110 and 112 may be provided in the discharge tube 111.

The oil separators 120 and 122 may include a first oil separator 120 provided on or at the outlet-side of the first compressor 110, and a second oil separator 122 provided on or at the outlet-side of the second compressor 112. The outdoor device 10 may include an oil collection passage 117 that collects oil from the first and second oil separators 120 and 122 to the first and second compressors 110 and 112. The oil collection passage 117 may extend from the first oil separator 120 to the first compressor 110 and from the second oil separator 122 to the second compressor 112.

An oil valve 118 that adjusts an amount of collected oil, and a first check valve 118*a* that guides one-directional flow of the refrigerant from the first and second oil separators 120 and 122 to the first and second compressors 110 and 112 may be provided in the oil collection passage 117. The outdoor device 10 may further include a bypass passage 117*a* that extends from each of the first and second oil separators 120 and 122 to the collection passage 117.

A second check valve 124 may be provided on or at an outlet-side of each of the first and second oil separators 120 and 122. The refrigerants discharged from the first and second oil separators 120 and 122 may pass through the second check valve 124 and then may be mixed with each other.

The outdoor device 10 may further include a high-pressure sensor 125 that detects a high pressure of the compressed refrigerant and a high-pressure switch 126 that selectively blocks a flow of the refrigerant according to the pressure detected by the high-pressure sensor 125. The high-pressure sensor 125 and the high-pressure switch 126 may be provided in a tube for the refrigerants which may be mixed after passing through the second check valve 124.

The outdoor device 10 may further include flow switches 130 and 135 that switch a flow direction of the refrigerant. The flow switches 130 and 135 may include first and second flow switches 130 and 135 that guide the refrigerant passing through the high-pressure sensor 125 toward an outdoor heat exchanger 140 or the indoor device.

The first and second flow switches 130 and 135 may be connected to each other in series. For example, a four way valve having one closed entrance may be provided as each of the first and second flow switches 130 and 135.

When the outdoor device for an air conditioner 10 performs a cooling operation, the refrigerant may be introduced from the first flow switch 130 to the outdoor heat exchanger 140, and the refrigerant evaporated in an indoor heat exchanger of the indoor device may be introduced into a second storage 205 through a low-pressure gas tube 195. On the other hand, when the outdoor device for an air conditioner 10 performs a heating operation, the refrigerant may flow from the second flow switch 135 to the indoor heat exchanger of the indoor device through a high-pressure gas tube 196, and the refrigerant evaporated in the outdoor heat exchanger 140 may be introduced into the second storage 205 via the first flow switch 130.

The outdoor heat exchanger 140 may include a plurality of heat exchangers 141 and 142 and at least one outdoor fan 143. The plurality of heat exchangers 141 and 142 may include a first heat exchanger 141 and a second heat exchanger 142, which may be connected in parallel to each other. When the heating operation is performed, a flow of the refrigerant passing through the first flow switch 130 into the second heat exchanger 142 may be restricted by a check valve 145*a*, and then the refrigerant may be introduced into the first heat exchanger 141.

The outdoor device 10 may further include a first heat exchanger temperature sensor 140*a* that detects a temperature of the refrigerant within the first heat exchanger 141, a second exchanger temperature sensor 140*b* that detects a temperature of the refrigerant within the second heat exchanger 141, and an outdoor temperature sensor 140*c* that detects a temperature of external air.

The outdoor heat exchanger 140 may further include a variable passage 144 that guides a flow of the refrigerant from an outlet-side of the first heat exchanger 141 to an inlet-side of the second exchanger 142. The variable passage 144 may extend from an outlet-side tube of the first heat exchanger 141 to an inlet-side tube of the second heat exchanger 142.

A variable valve 145 that selectively blocks a flow of the refrigerant flowing toward the variable passage 144 may be provided in the outdoor heat exchanger 140. The refrigerant passing through the first heat exchanger 141 may be selectively introduced into the second exchanger 142 according to an on/off of the variable valve 145. For example, the variable valve 145 may include a solenoid vale.

When the variable valve 145 is turned on or opened, the refrigerant passing through the first heat exchanger 141 may be introduced into the second heat exchanger 142 via the variable passage 144. A first outdoor valve 147*a* provided in an outlet-side tube 147 of the first heat exchanger 141 may be closed.

A second outdoor valve 148*a* may be provided in an outlet-side tube 148 of the second heat exchanger 142, and the refrigerant heat-exchanged in the second heat exchanger 142 may be introduced into a first supercooler 150 through the opened second outdoor valve 148*a*. On the other hand, when the variable valve 145 is turned off or closed, a flow of the refrigerant into the second heat exchanger 142 may be restricted. The refrigerant passing through the first heat exchanger 141 may be introduced into the first supercooler 150 via the first outdoor valve 147*a*.

The first and second outdoor valves 147*a* and 148*a* may be provided in parallel to each other to correspond to the first and second heat exchangers 141 and 142. For example, each of the first and second outdoor valves 147*a* and 148*a* may include an electronic expansion valve (EEV) by which the refrigerant may be decompressed.

A first bypass tube 149*a* and a second bypass tube 149*b* may be connected to the outlet-side tube 147 of the first heat exchanger 141 and the outlet-side tube 148 of the second heat exchanger 142, respectively. Each of the first and second bypass tubes 149*a* and 149*b* may extend from an inlet-side of the first flow switch 130 to the outlet-side tubes 147 and 148 to selectively bypass the high-pressure refrigerant discharged from the first and second compressors 110 and 112 to the outlet-sides of the first and second heat exchangers 141 and 142. First and second bypass valves 149*c* and 149*d*, each of which may be adjustable in opening degree, may be provided in the first and second bypass tubes 149*a* and 149*b*, respectively.

The outlet-side tube 148 of the second heat exchanger 142 may further include a heat exchanger bypass tube 148*e* that bypasses the second outdoor valve 148*a*, and a third check valve 148*b* provided in or on the heat exchanger bypassing tube 148*e*.

First and second supercoolers 150 and 170 may be provided on the outlet side of the outdoor heat exchanger 140. The first and second supercoolers 150 and 170 may include the first supercooler 150 and a second supercooler 170.

When the outdoor device for an air conditioner 10 performs the cooling operation, the refrigerant condensed in the outdoor heat exchanger 140 may successively pass through the first supercooler 150 and the second supercooler 170. On the other hand, when the outdoor device for an air conditioner 10 performs the heating operation, the refrigerant passing through the second supercooler 170 may be introduced into the first supercooler 150.

The first supercooler 150 may be a first intermediate heat exchanger in which a first refrigerant circulating through a refrigerant system and a portion (a second refrigerant) of the refrigerant may be branched and then heat-exchanged. The second refrigerant heat-exchanged in the first supercooler 150 may be injected into the first and second compressors 110 and 112.

The outdoor device 10 may include a first supercooling passage 151, through which the second refrigerant may be branched and then guided to the first supercooler 150. The first supercooling passage 151 may extend from the first supercooler 150 to the first and second compressors 110 and 112.

A first supercooling expansion device 153 that decompresses the second refrigerant may be provided in the first supercooling passage 151. The first supercooling expansion device 153 may include an electronic expansion valve (EEV).

A plurality of temperature sensors 154 and 155 may be provided in the first supercooling passage 151. The plurality of temperature sensors 154 and 155 may include a first temperature sensor 154 that detects a refrigerant temperature before the refrigerant is introduced into the first supercooler 150, and a second temperature sensor 155 that detects a refrigerant temperature after the refrigerant passes through the first supercooler 150. While the first and second refrigerants are heat-exchanged in the first supercooler 150, the first refrigerant may be supercooled, and the second refrigerant may be overheated.

A "first overheated degree" of the second refrigerant may be determined on the basis of a temperature value of the refrigerant detected by each of the first and second temperature sensors 154 and 155. For example, a temperature value detected by the first temperature sensor 155, which is subtracted from a temperature value detected by the second temperature sensor 154, may be determined as the "first overheated degree".

The second refrigerant heat-exchanged in the first supercooler 150 may be branched and then injected into the first and second compressors 110 and 112. Thus, the first supercooling passage 151 may be referred to as a "first injection passage". The first supercooling passage 151 may be branched into a first branch passage 156*a* and a second branch passage 156*b* and then connected to the first and second compressors 110 and 112, respectively. The first and second branch passages 156*a* and 156*b* may be referred to as the "first injection passage".

After the refrigerant is heat-exchanged in the first supercooler 150, a first portion of the refrigerant within the first supercooling passage 151 may be injected into a first injection port of the first compressor 110 via the first branch passage 156*a*. After the refrigerant is heat-exchanged in the first supercooler 150, a second portion of the refrigerant within the first supercooling passage 151 may be injected into a first injection port of the second compressor 112 via the second branch passage 156*b*. The refrigerant injected into the first and second compressors 110 and 112 may have a medium pressure, that is, a pressure which is greater than a suction pressure of the compressor and less than a discharge pressure of the compressor.

A first branch 158 may be provided in or at an outlet-side of the first supercooler 150. Of the first refrigerant passing through the first supercooler 150, a first portion of the refrigerant branched from the first branch 158 may be introduced into an electronic cooling portion 159, and a second portion may be introduced into a first storage 201. The electronic cooling portion 159 may pass through one side of an electronic device, in which a heat generation component is installed, to cool the heat generation component.

The second supercooler 170 may be provided on or at an outlet-side of the electronic cooling portion 159. The first supercooler 150, the electronic cooling portion 159, and the second supercooler 170 may be arranged in series.

In the cooling operation, the first refrigerant heat-exchanged in the first supercooler 150 may be introduced into the second supercooler 170 via the electronic cooling portion 159. On the other hand, in the heating operation, the refrigerant heat-exchanged in the second supercooler 170 may be introduced into the first supercooler 150 via the electronic cooling portion 159. The second supercooler 170 may be a second intermediate heat exchanger in which the first refrigerant circulating through the refrigerant system and a portion (the second refrigerant) of the refrigerant may be branched and then heat-exchanged.

The outdoor device 10 may include a second supercooling passage 171 from which the second refrigerant may be branched. A supercooling expansion device 173 that decompresses the second refrigerant may be provided in the supercooling passage 171. The supercooling expansion device 173 may include an electronic expansion valve (EEV).

A plurality of temperature sensors 174 and 175 may be provided in the second supercooling passage 171. The plurality of temperature sensors 174 and 175 may include a third temperature sensor 174 that detects a refrigerant temperature before the refrigerant is introduced into the second supercooler 170, and a fourth temperature sensor 175 that detects a refrigerant temperature after the refrigerant passes through the second supercooler 170.

While the first and second refrigerants are heat-exchanged in the second supercooler 170, the first refrigerant may be supercooled, and the second refrigerant may be overheated. A "second overheated degree" of the third refrigerant may be determined on the basis of a temperature value of the refrigerant detected by each of the third and fourth temperature sensors 174 and 175. For example, a temperature value detected by the third temperature sensor 174, which is subtracted from a temperature value detected by the fourth temperature sensor 175, may be determined as the "second overheated degree".

The second refrigerant heat-exchanged in the second supercooler 170 may be injected into the first and second compressors 110 and 112 or bypassed to the second storage 205. The second supercooling passage 171 may include a second injection passage 176 (176*a*, 176*b*) that injects the refrigerant into the first and second compressors 110 and 112, and a second branch 182 which may be branched into a bypass passage 181 that bypasses the refrigerant to the second storage 205.

The second injection passage 176 may include third and fourth branch passages 176*a* and 176*a*, which may respectively extend to the first and second compressors 110 and 112. The third branch passage 176*a* may be connected to a second injection port of the first compressor 110, and the fourth branch passage 176*b* may be connected to a second injection port of the second compressor 112.

An injection valve 177 that adjusts a flow rate of the refrigerant may be provided in each of the third and fourth branch passages 176*a* and 176*b*. The injection valve 177 may include an electric expansion valve (EEV), an opening degree of which may be adjustable.

After the refrigerant is heat-exchanged in the second supercooler 170, a first portion of the refrigerant within the second supercooling passage 171 may be branched at the second branch 182 and then injected into a second injection port of the first compressor 110 via the third branch passage 176*a*. A second portion of the refrigerant branched at the second branch 182 may be injected into the second injection port of the second compressor 112 via the fourth branch passage 178*b*. The injected refrigerant may have a medium pressure, that is, a pressure which is greater than a suction pressure of the compressor and less than a discharge pressure of the compressor.

Referring to FIG. 2, the outdoor device 10 may further include a refrigerant storage 200 that stores the refrigerant. The refrigerant storage 200 may receive and store the refrigerant circulating through the refrigerant system. That is, the refrigerant storage 200 may be a component that introduces at least a portion of the stored refrigerant into the compressors 110 and 112.

The refrigerant storage 200 may include the first storage 201 and the second storage 205. The second storage 205 may be a component that separates a gaseous refrigerant from the refrigerant before the refrigerant is introduced into the compressors 110 and 112.

The outdoor device 10 may further include a low-pressure tube 184 that extends from each of the first and second flow switches 130 and 135 to the second storage 205. The low-pressure refrigerant evaporated in the refrigerant cycle may be introduced from the first flow switch 130 or the second flow switch 135 into the second storage 205 via the low-pressure tube 184.

The second storage 205 may include an inflow port 211 connected to the low-pressure tube 184, and a supercooling port 212 connected to the bypass passage 181. The bypass passage 181 may extend from the second branch 182 to the supercooling port 212 of the second storage 205.

A bypass valve 183 that selectively blocks a flow of the refrigerant may be provided in the bypass passage 181. An amount of refrigerant introduced into the second storage 205 may be adjusted by an on/off operation and an opening degree of the bypass valve 183. For example, the bypass valve 183 may include a solenoid valve.

The first storage 201 may be a component that stores at least a portion of the refrigerant circulating through the system.

The outdoor device 10 may further include a receiver inlet tube 163 connected to an inlet-side of the first storage 201. The receiver inlet tube 163 may extend from the first branch 158 to the first storage 201.

A receiver inlet valve 164*a* that adjusts a flow of the refrigerant may be provided in the receiver inlet tube 163. When the receiver inlet valve 164*a* is opened, at least a portion of the refrigerant circulating through the system may be introduced into the first storage 201. For example, the receiver inlet valve 164*a* may include a solenoid valve.

A decompression device 164*b* may be provided on the receiver inlet tube 163 to decompress the refrigerant introduced into the first storage 201. For example, the decompression device 164*b* may include a capillary tube. While the refrigerant passes through the decompression device 164*b*, a flow speed or rate of the refrigerant may be reduced.

The outdoor device 10 may further include a receiver outlet tube 260 that extends from the first storage 201 to the second storage 205. At least a portion of the refrigerant stored in the first storage 201 may be introduced into the second storage 205 through the receiver outlet tube 260.

The outdoor device 10 may include a liquid discharge port 261 provided on the first storage 201 and to which the receiver outlet tube 260 may be connected, and a liquid inflow port 262 provided on the second storage 205 and to which the receiver outlet tube 260 may be connected.

For example, the liquid discharge port 261 may be provided on a lower portion of the first storage 201, and a first side of the receiver outlet tube 260 may be connected to the liquid discharge port 261. The liquid inflow port 262 may be provided on an upper portion of the second storage 205, and a second side of the receiver outlet tube 260 may be connected to the liquid inflow port 262.

A receiver outlet valve 264, which may be capable of adjusting an amount of refrigerant discharged from the first storage 201, may be provided in or on the receiver outlet tube 260. An amount of refrigerant introduced into the second storage 205 may be adjusted according to an on/off or opening degree of the receiver outlet valve 264.

In a state in which the receiver outlet valve 264 is opened, the refrigerant stored in the first storage 201 of the refrigerant storage 200 may be introduced into the second storage 205. For example, the receiver outlet valve 264 may include a solenoid valve.

The outdoor device 10 may further include a suction tube 169 that extends from the second storage 205 toward the first and second compressors 110 and 112 to guide the suctioned refrigerant into the first and second compressors 110 and 112. The suction tube 169 may be coupled to a discharge port 215 of the refrigerant storage 200. The suction tube 169 may be branched and then connected to a first port of the first compressor 110 and a first port of the second compressor 112.

A low-pressure sensor 169*d* that detects a pressure of the refrigerant introduced into the first and second compressors 110 and 112, that is, a low pressure of the system may be provided in the suction tube 169.

The outdoor device 10 may further include an oil return tube 190 that extends from the second storage 205 to the suction tube 169. The oil stored in the second storage 205 may be introduced into the suction tube 169 through the oil return tube 190. The oil return tube 190 may be coupled to an oil discharge port 218 of the refrigerant storage 200.

An oil valve 191 that adjusts an amount of oil may be provided in the oil return tube 190. For example, the oil valve 191 may include a solenoid valve.

The outdoor device 10 may further include an oil supply tube 119 that supplies the oil within the first and second compressors 110 and 112 into the suction tube 169. The oil supply tube 119 may extend from each of the first and second compressors 110 and 112, and then, the extending oil supply tubes 119 may be combined with each other and connected to the suction tube 169.

The first refrigerant passing through the second supercooler 170 may be introduced into the indoor device through a liquid tube 197. A liquid tube temperature sensor 197*a* that detects a temperature of the refrigerant flowing through the liquid tube 197 may be provided in the liquid tube 197.

Figure 3:
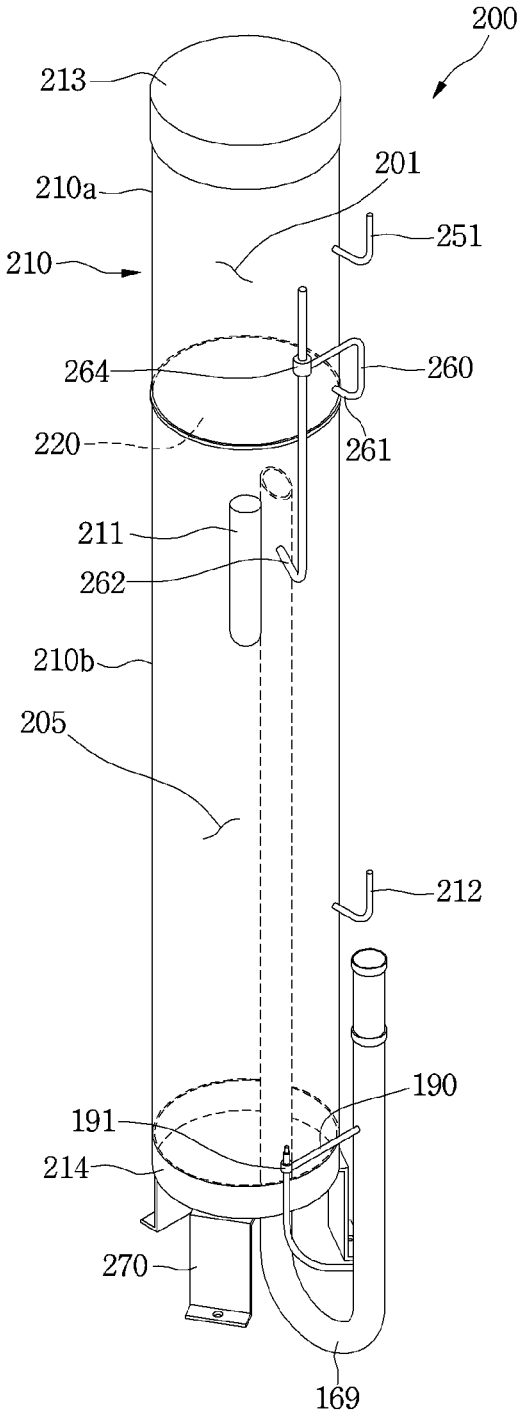
FIG. 3 is a view of a refrigerant storage according to an embodiment.
Figure 4:
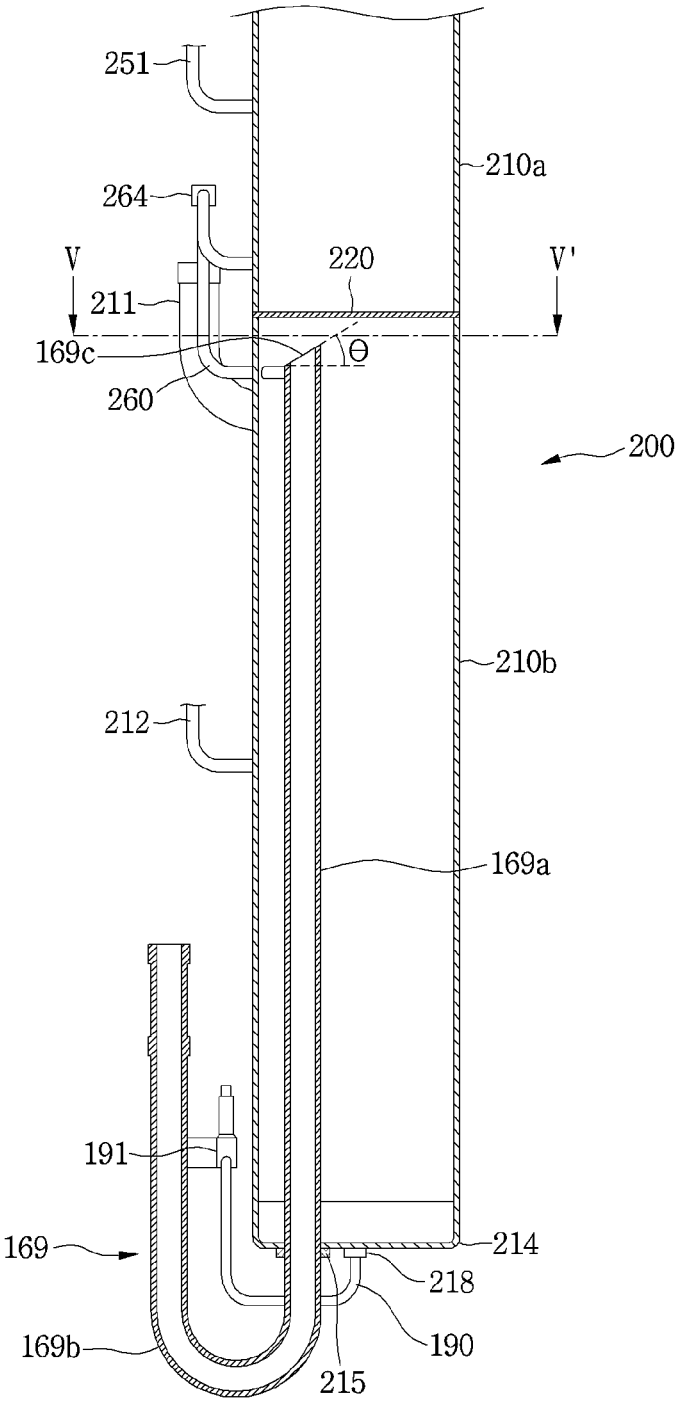
FIG. 4 is a cross-sectional view of the refrigerant storage according to an embodiment.
Figure 5:
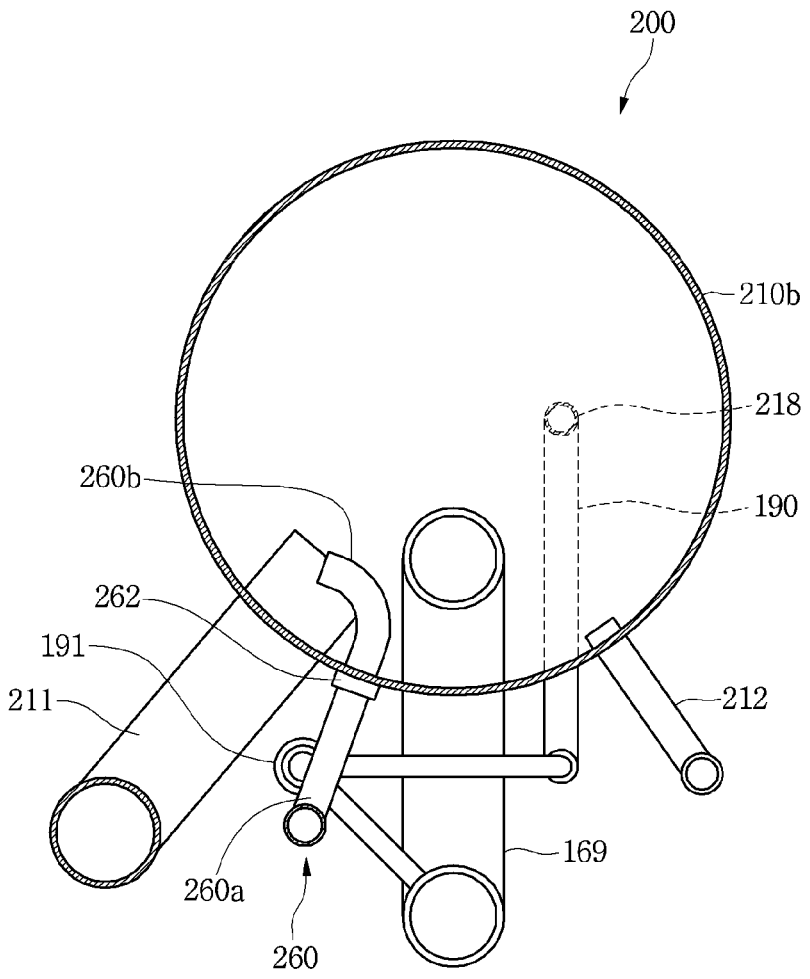
FIG. 5 is a cross-sectional view taken along line V-V' of FIG. 4.

FIG. 3 is a view of the refrigerant storage according to an embodiment. FIG. 4 is a cross-sectional view of the refrigerant storage according to an embodiment. FIG. 5 is a cross-sectional view taken along line V-V' of FIG. 4.

Referring to FIGS. 3 to 5, the refrigerant storage 200 according to an embodiment may include a main body or case 210 that defines storage spaces 201 and 205 for the refrigerant, and a partition plate 220 that vertically partitions the storage spaces 201 and 205. An upper cover 213 may be provided on an upper portion of the case 210, and a lower cover 214 may be provided on a lower portion of the case 210. A mount 270 to mount the refrigerant storage 200 at a predetermined place may be provided under the lower cover 214.

The storage spaces 201 and 205 may include the first storage 201 defined above the partition plate 220 and the second storage 205 defined below the partition plate 220. The second storage 205 may have a capacity greater than a capacity of the first storage 201.

The case 210 may have an approximately cylindrical shape with upper and lower portions opened. The case 210 may include a first case 210*a* that defines the first storage 201, and a second case 210*b* that defines the second storage 105. That is, a portion of the case 210, which may be provided above the partition plate 220, may be defined as the first case 210*a*, and a portion of the case 210, which may be provided below the partition plate 220, may be defined as the second case 210*b*. The first and second cases 210*a* and 210*b* may be integrated with each other.

The first case 210*a* may include a connection portion 251, to which the receiver inlet tube 163 may be coupled, to introduce the refrigerant of the receiver inlet tube 163 into the first storage 201, and the liquid discharge port 261 to which the receiver outlet tube 260 may be coupled to guide the liquid refrigerant in the first storage 201 to the second storage 205. For example, the connection portion 251 may be provided on an upper portion of the first case 210*a*, and the liquid discharge port 261 may be provided on a lower portion of the first case 210*a*.

The second case 210*b* may include the liquid inflow port 262, to which the receiver outlet tube 260 may be coupled, to introduce the liquid refrigerant discharged from the liquid discharge port 261 therethrough. For example, the liquid inflow port 262 may be provided on an upper portion of the second case 210*b*. Also, the receiver outlet tube 260 may be provided between the liquid discharge port 261 and the liquid inflow port 262. The receiver outlet tube 260 may extend downward from the liquid discharge port 261 toward the liquid inflow port 262. As the liquid discharge port 261 may be provided at a position which is higher than a position of the liquid inflow port 262, the liquid refrigerant stored in the first storage 201 may easily flow into the second storage 205 using a natural gradient or gravity without using a separate drive source.

The receiver outlet tube 260 may include an outer tube 260*a* provided outside of the second storage 205 and an inner tube 260*b* that extends from the outer tube 260*a* and provided inside of the second storage 205. The outer tube 260*a* may extend in a normal direction of the case 210 and then may be coupled to the case 210.

The inner tube 260*b* may be bent in one direction within the second storage 205. The one direction may be a direction that extends away from the suction tube 169. As the inner tube 260*b* is bent, the liquid refrigerant supplied into the case 210 may flow in the direction that extends away from the suction tube 169. Thus, it may prevent the liquid refrigerant from being introduced into the suction tube 169 into which the gaseous refrigerant is introduced.

The second case 210*b* may include the inflow port 211, to which the low-pressure tube 184 may be coupled, to introduce the refrigerant into the second storage 205. For example, the inflow port 211 may be provided on an upper portion of the second case 210*b*. The refrigerant introduced through the inflow port 211 may be an evaporated refrigerant, have high dryness, and may be stored in the second storage 205.

The lower cover 214 may include the discharge port 215 to which the suction tube 169 may be coupled. The suction tube 169 may include a first tube 169*a* provided inside of the second case 210*b*, and a second tube 169*b* provided outside of the second case 210*b*. That is, the first tube 169*a* may be provided inside of the discharge port 215, and the second tube 169*b* may be provided outside of the discharge port 215.

The first tube 169*a* may extend lengthwise in an upward direction from the lower cover 214 to the partition plate 220. An inflow end 169*c*, through which the refrigerant in the second storage 205 may be introduced, may be provided on the first tube 169*a*. As the gaseous refrigerant has to be introduced into the first tube 169*a*, the inflow end 169*c* may be provided at a height such that the inflow end 169*c* is positioned adjacent to the partition plate 220, that is, an uppermost portion of the second storage 205.

The inflow end 169*c* may horizontally extend, for example, at an incline, that is, at a predetermined angle θ with respect to the lower cover 214. As the inflow end 169*c* is provided at the height such that the inflow end 169*c* is positioned adjacent to the partition plate 220, a flow of the refrigerant into the inflow end 169*c* may be restricted. Thus, the inflow end 169*c* may be inclined so that the inflow end 69*c* increases in cross section. Thus, introduction of the refrigerant may be smooth. For example, the predetermined angle θ may range from about 20° to about 40°. The second tube 169*b* may extend in a downward direction through the discharge port 215 of the lower cover 214, and then may be bent in an upward direction to extend toward the compressor 110.

The oil discharge port 218, through which oil stored in the second storage 205 may be discharged, may be provided on the lower cover 214. The oil return tube 190 may extend from the oil discharge port 218 to the suction tube 169. The refrigerant discharged from the oil discharge port 218 may return to the compressors 110 and 112 via the oil return tube 190 and the suction tube 169. The oil valve 191 may be provided in or on the oil return tube 190 to adjust a discharge amount of oil.

The second case 210*b* may include the supercooling port 212, to which the bypass passage 181 may be connected. As the refrigerant flowing through the bypass passage 181 may be directly supplied into the second storage 205 having a relatively large volume, flow noise of the refrigerant may decrease. If the refrigerant flowing through the bypass passage 181 is supplied into the suction tube 169 having a relatively small volume, flow noise of the refrigerant may increase.

As the refrigerant introduced through the low-pressure tube 184 may have been evaporated in an evaporator, the refrigerant may be a refrigerant having high dryness at which a low pressure (evaporation pressure) is generated in the refrigerant system. On the other hand, as the refrigerant introduced through the receiver inlet tube 163 is a refrigerant which is supercooled in the first supercooler 150, the refrigerant may be liquid refrigerant or refrigerant having low dryness, at which a high pressure (condensation pressure) is generated in the refrigerant system.

Thus, the refrigerant stored in the first storage 201 and the refrigerant stored in the second storage 205 may be heat-exchanged with each other. The refrigerant stored in the first storage 201 and having a relatively high-temperature and high-pressure may be cooled, and the refrigerant stored in the second storage 205 and having a relatively low-temperature and low-pressure may absorb heat.

While the refrigerant of the first storage 201 is cooled, gaseous refrigerant of the refrigerant introduced through the receiver inlet tube 163 may be condensed. Thus, the liquid refrigerant may be filled into the first storage 201. The liquid refrigerant may be supplemented into the refrigerant system according to predetermined conditions. Also, the refrigerant of the second storage 205 may absorb heat from the refrigerant of the first storage 201 to phase-change into a gaseous refrigerant. The phase-changing gaseous refrigerant may be suctioned into the compressors 110 and 112 through the suction tube 169.

The first storage 201 may be referred to as a "receiver" in that the condensed refrigerant may be temporarily stored and then supplied into the second storage 205 through the first storage 201. The second storage 205 may be referred to as a "gas/liquid separator" in that gaseous refrigerant of evaporated refrigerant may be introduced into the compressors 110 and 112 through the second storage 205. Thus, the refrigerant storage 200 may be a device in which the receiver and the gas/liquid separator are integrated with each other.

A flow of the refrigerant in the air conditioner 100 according to an embodiment will be described hereinafter.

The refrigerant compressed in the compressors 110 and 112 may be introduced into the outdoor heat exchanger 140 or the indoor heat exchanger and then condensed. At least a portion of the branched refrigerant of the condensed refrigerant may be introduced into the first supercooler 150, and then heat-exchanged in the first supercooler 150. Then, the refrigerant may be introduced into the first storage 201 via the receiver inlet tube 163 and the connection portion 251 of the first case 210*a*.

At least a portion of the refrigerant heat-exchanged in the second supercooler 170 may be introduced into the second storage 205 via the bypass passage 181 and the supercooling port 212 of the second case 210*b*. As the refrigerant flowing through the bypass passage 181 is supplied into the second storage 205 having the relatively large volume, flow noise of the refrigerant may decrease.

The refrigerant evaporated in the outdoor heat exchanger 130 or the indoor heat exchanger may be introduced into the second storage 205 via the low-pressure tube 184 and the inflow port 211 of the second case 210*b*. The liquid refrigerant stored in the first storage 201 may flow into the second storage 205 through the receiver outlet tube 260. As the liquid discharge port 261 of the first case 210*a* may be provided at a height which is higher than a height of the liquid inflow port 262 of the second case 210*b*, flow of the refrigerant may be smooth.

The refrigerant stored in the second storage 205 may be discharged into the suction tube 169 through the discharge port 215 and be suctioned into the compressors 110 and 112. The oil stored in the second storage 205 may flow into the suction tube 169 through the oil discharge port 218, and then, may return to the compressors 110 and 112 together with the refrigerant.

According to embodiments disclosed herein, as the first storage in which the refrigerant passing through the condenser may be stored and the second storage in which the refrigerant to be introduced into the compressor may be stored may be integrated with each other, the outdoor device for an air conditioner may be simplified in structure. Also, as the first storage is provided above the second storage, liquid refrigerant stored in the first storage may be introduced into the second storage by gravity thereof. Thus, the refrigerant may be smoothly supplied into the second storage.

Further, as the refrigerant passing through the supercooling device may be directly supplied into the refrigerant storage device via the bypass tube, the occurrence of noise due to flow of the refrigerant may be reduced. For example, when compared to a case in which the refrigerant passing through the supercooling device is supplied into a low pressure tube, the occurrence of noise due to flow of the refrigerant may be reduced.

Furthermore, as heat transfer is realized through the partition plate that partitions the first storage from the second storage, gaseous refrigerant stored in the first storage may change into liquid refrigerant. As a result, as the liquid refrigerant may be stored in the first storage and introduced into the second storage, an amount of refrigerant circulating through the system may increase.

Also, as a refrigerant system for bearing a load of the air-conditioner may be variable in performance by changing only an amount of refrigerant flowing through the refrigerant cycle without changing an operation rate of the compressor, a whole operation efficiency of the refrigerant system may be improved.

Embodiments disclosed herein provide an outdoor device for an air conditioner in which a refrigerant may be smoothly supplied from a receiver to a gas/liquid separator to reduce an occurrence of noise.

Embodiments disclosed herein provide an outdoor device for an air conditioner that may include a compressor that compresses a refrigerant; a condenser that condenses the refrigerant which is compressed in the compressor; an expansion device that decompresses the refrigerant which is condensed in the condenser; an evaporator that evaporates the refrigerant which is decompressed in the expansion device; and a refrigerant storage device or storage that bypasses at least a portion of the refrigerant which is condensed in the condenser to store the bypassed refrigerant therein. The refrigerant storage device may include a first storage part or storage that stores the bypassed refrigerant; and a second storage part or storage in which the refrigerant passing through the evaporator may be introduced. The second storage part may discharge a gaseous refrigerant of the introduced refrigerant into the compressor. The first storage part may be disposed or provided above the second storage part to supply the refrigerant stored therein into the second storage part.

The outdoor device for an air conditioner may further include a receiver outlet tube that extends from the first storage part toward the second storage part to guide a flow of the refrigerant stored in the first storage part into the second storage part using a natural gradient or gravity. The outdoor device for an air conditioner may further include a liquid discharge port provided in the first storage part and to which one or a first side of the receiver outlet tube may be coupled, and a liquid inflow port provided in the second storage part and to which the other or a second side of the receiver outlet tube may be coupled. The liquid discharge port may be disposed or provided on a lower portion of the first storage part, and the liquid inflow port may be disposed or provided on an upper portion of the storage part.

The outdoor device for an air conditioner may further include a receiver outlet valve disposed or provided in the receiver outlet tube to adjust an amount of refrigerant discharged from the first storage part. The outdoor device for an air conditioner may further include a case that defines the first storage part and the second storage part, and a partition plate disposed or provided inside the case to partition the first storage part from the second storage part. The case may include a first case that defines the first storage part, and a second case that defines the second storage part. The first and second cases may be integrated with each other.

The outdoor device for an air conditioner may further include a suction tube disposed or provided in the second case to guide the refrigerant of the second storage part into the compressor, and a lower cover disposed or provided on a lower portion of the case. The lower cover may include a discharge port to which the suction tube may be connected.

The suction tube may include a first tube part or tube disposed or provided inside the second case to extend upward to the partition plate, and a second tube part or tube disposed or provided outside the second case to extend to be bent upward from the lower cover. The first tube part may include an inflow end disposed or provided on an upper portion of the second storage part to introduce the refrigerant existing in the second storage part therein. The inflow end may extend to be inclined at a preset or predetermined angle (θ) with respect to the lower cover.

The receiver outlet tube may include an outer tube part or tube disposed or provided outside the second storage part, and an inner tube part or tube that extends from the outer tube part and disposed or provided inside the second storage part. The inner tube part may be bent in a direction which is away from the suction tube.

The outdoor device for an air conditioner may further include a first supercooler that supercools the refrigerant which is condensed in the condenser; a receiver inlet tube that guides the refrigerant passing through the first supercooler into the first storage part; and a receiver inlet valve disposed or provided in the receiver inlet tube. The outdoor device for an air conditioner may further include an oil discharge port disposed or provided on the lower cover to discharge the refrigerant stored in the second storage part; an oil return tube that extends from the oil discharge port to the suction tube; and an oil valve disposed or provided in the oil return tube to adjust a flow rate of oil.

Embodiments disclosed herein provide an outdoor device for an air conditioner that may include a compressor that compresses a refrigerant; a condenser that condenses the refrigerant which is compressed in the compressor; a first supercooler that supercools the refrigerant which is condensed in the condenser; a second supercooler disposed or provided on an outlet-side of the first supercooler; a receiver including a connection port into which at least a portion of the refrigerant passing through the first supercooler may be introduced; a gas/liquid separator into which at least a portion of the refrigerant passing through the second supercooler may be introduced; and a receiver outlet tube that extends downward from the receiver toward the gas/liquid separator to guide a liquid refrigerant within the receiver so that the liquid refrigerant may be introduced into the gas/liquid separator. The outdoor device for an air conditioner may further include a receiver outlet valve disposed or provided in the receiver outlet tube.

The receiver and the gas/liquid separator may be integrated with each other and vertically separated by a partition plate.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor device for an air conditioner, comprising:
- a compressor that compresses a refrigerant;
- a condenser that condenses the refrigerant compressed in the compressor;
- an expansion device that decompresses the refrigerant condensed in the condenser;
- an evaporator that evaporates the refrigerant decompressed in the expansion device;
- a refrigerant storage that bypasses at least a portion of the refrigerant condensed in the condenser to store the bypassed refrigerant therein, wherein the refrigerant storage includes:
  - a case;
  - a receiver that is formed within the case and stores the bypassed refrigerant;
  - a gas/liquid separator provided under the receiver and into which the refrigerant passing through the evaporator is introduced, a capacity of the gas/liquid separator being greater than a capacity of the receiver;
  - a partition plate provided between the receiver and the gas/liquid separator to separate the receiver from the gas/liquid separator;
  - a receiver outlet tube that extends from the receiver to the gas/liquid separator downward to guide a flow of the refrigerant stored in the receiver into the gas/liquid separator;
  - a liquid discharge port provided in a lower portion of the receiver and to which a first portion of the receiver outlet tube is coupled;
  - a liquid inflow port provided in an upper portion of the gas/liquid separator and to which a second portion of the receiver outlet tube is coupled; and
  - a receiver outlet valve installed on the receiver outlet tube to adjust an amount of the refrigerant discharged from the receiver.

2. The outdoor device according to claim 1, wherein the case includes a first case that defines the receiver and a second case that defines the gas/liquid separator, and wherein the first and second cases are integrated with each other.

3. The outdoor device according to claim 2, further including:
- a suction tube provided in the second case to guide the refrigerant of the gas/liquid separator to the compressor; and a lower cover provided on a lower portion of the second case, wherein the lower cover includes a discharge port to which the suction tube is connected.

4. The outdoor device according to claim 3, wherein the suction tube includes:

a first tube provided inside of the second case to extend in an upward direction such that an end thereof is adjacent the partition plate; and a second tube provided outside of the second case to extend to be bent in the upward direction from the lower cover.

5. The outdoor device according to claim 4, wherein the end of the first tube is an inflow end provided at an upper portion of the gas/liquid separator to introduce the refrigerant stored in the gas/liquid separator therein.

6. The outdoor device according to claim 5, wherein the inflow end extends at an incline at a predetermined angle with respect to the lower cover.

7. The outdoor device according to claim 3, further including:

an oil discharge port provided on the lower cover to discharge oil stored in the gas/liquid separator;

an oil return tube that extends from the oil discharge port to the suction tube; and an oil valve provided in the oil return tube to adjust a flow rate of oil.

8. The outdoor device according to claim 2, wherein the receiver outlet tube includes an outer tube provided outside of the gas/liquid separator and an inner tube that extends from the outer tube and provided inside of the gas/liquid separator, and wherein the inner tube is bent in a direction away from the suction tube.

9. The outdoor device according to claim 1, further including:

a first supercooler that supercools the refrigerant condensed in the condenser;

a receiver inlet tube that guides the refrigerant passing through the first supercooler into the receiver; and a receiver inlet valve provided in the receiver inlet tube.

10. An air conditioner including the outdoor device according to claim 1.

11. A refrigerant storage for an outdoor device for an air conditioner, the refrigerant storage bypassing at least a portion of a refrigerant condensed in a condenser to store the bypassed refrigerant therein and comprising:

a case;

a receiver that is formed within the case and stores the bypassed refrigerant;

a gas/liquid separator provided under the receiver and into which the refrigerant passing through an evaporator is introduced, a capacity of the gas/liquid separator being greater than a capacity of the receiver;

a partition plate provided between the receiver and the gas/liquid separator to separate the receiver from the gas/liquid separator, a receiver outlet tube that extends from the receiver to the gas/liquid separator downward to guide a flow of the refrigerant stored in the receiver into the gas/liquid separator;

a liquid discharge port provided in a lower portion of the receiver and to which a first portion of the receiver outlet tube is coupled;

a liquid inflow port provided in an upper portion of the gas/liquid separator and to which a second portion of the receiver outlet tube is coupled; and a receiver outlet valve installed on the receiver outlet tube to adjust an amount of refrigerant discharged from the receiver.

12. The refrigerant storage according to claim 11, wherein the case includes a first case that defines the receiver and a second case that defines the gas/liquid separator, and wherein the first and second cases are integrated with each other.

13. The refrigerant storage according to claim 12, further including:

a suction tube provided in the second case to guide the refrigerant of the gas/liquid separator to the compressor; and a lower cover provided on a lower portion of the second case, wherein the lower cover includes a discharge port to which the suction tube is connected.

14. The refrigerant storage according to claim 13, wherein the suction tube includes:

a first tube provided inside of the second case to extend in an upward direction such that an end thereof is adjacent the partition plate; and a second tube provided outside of the second case to extend to be bent in the upward direction from the lower cover, wherein the end of the first tube is an inflow end provided at an upper portion of the gas/liquid separator to introduce the refrigerant stored in the gas/liquid separator therein, and wherein the inflow end extends at an incline at a predetermined angle with respect to the lower cover.

15. The refrigerant storage according to claim 13, further including:

an oil discharge port provided on the lower cover to discharge oil stored in the gas/liquid separator;

an oil return tube that extends from the oil discharge port to the suction tube; and an oil valve provided in the oil return tube to adjust a flow rate of oil.

16. The refrigerant storage according to claim 13, wherein the outlet tube includes an outer tube provided outside of the gas/liquid separator and an inner tube that extends from the outer tube and provided inside of the gas/liquid separator, and wherein the inner tube is bent in a direction away from the suction tube.

17. The refrigerant storage according to claim 11, further including:

an inlet tube configured to guide refrigerant passing through a first supercooler into the receiver; and an inlet valve provided in the inlet tube.

18. An air conditioner including the refrigerant storage according to claim 11.

19. The outdoor device according to claim 6, wherein the predetermined angle may range from about 20° to about 40°.

20. The refrigerant storage according to claim 14, wherein the predetermined angle may range from about 20° to about 40°.

* * * * *